US008388171B2

(12) United States Patent
Tung et al.

(10) Patent No.: US 8,388,171 B2
(45) Date of Patent: Mar. 5, 2013

(54) WATERPROOF LED LAMP TUBE AND CASING OF SAME

(75) Inventors: Chienchen Tung, Zhaoqing (CN); Qing Ma, Zhaoing (CN); Kegang Yue, Zhaoqing (CN); Deliang Xiao, Zhaoqing (CN); Xianhua Zhao, Zhaoqing (CN)

(73) Assignee: Ledtech Electronics Corp., Zhaoqing, Guangdong (CN)

( * ) Notice: Subject to any disclaimer, the term of this patent is extended or adjusted under 35 U.S.C. 154(b) by 0 days.

(21) Appl. No.: 13/275,942

(22) Filed: Oct. 18, 2011

(65) Prior Publication Data

US 2012/0250301 A1 Oct. 4, 2012

(30) Foreign Application Priority Data

Mar. 31, 2011 (CN) ..... 2011 2 0090660 U
Mar. 31, 2011 (CN) ..... 2011 2 0090695 U

(51) Int. Cl.
*F21V 21/00* (2006.01)

(52) U.S. Cl. ..... 362/217.01; 362/223; 362/235

(58) Field of Classification Search ..... 362/217.01, 362/223, 227, 235, 241, 249.01; 313/498, 313/512
See application file for complete search history.

(56) References Cited

U.S. PATENT DOCUMENTS

2011/0069484 A1* 3/2011 Wu et al. ..... 362/235

* cited by examiner

*Primary Examiner* — Vip Patel
(74) *Attorney, Agent, or Firm* — Muncy, Geissler, Olds & Lowe, PLLC

(57) ABSTRACT

An LED lamp tube with improved sealing and cooling performance includes a plastic tube shell, an LED lamp strip, a metal casing and two end caps. The plastic tube shell is elongate and includes a light condensing structure and a light reflection structure integrally formed by extrusion and an installation chamber formed between the light condensing structure and the light reflection structure. The LED lamp strip is held in the installation chamber and at one side of the light reflection structure. The metal casing is coupled on the outer side of the light reflection structure. Each of the end caps is coupled on each of two ends of the plastic tube shell, thus can achieve IP67 waterproof and dustproof level, and also can resolve cooling problem of the lamp tube.

20 Claims, 7 Drawing Sheets

WATERPROOF LED LAMP TUBE AND CASING OF SAME

FIELD OF THE INVENTION

The present invention relates to an LED lamp and particularly to a waterproof LED lamp tube and casing thereof.

BACKGROUND OF THE INVENTION

The conventional LED lamp tubes adopted for outdoor illumination and used in high humidity environments mostly have an LED lamp strip sealed in a plastic tube via sealant to achieve waterproof effect. But such a structure does not provide desirable heat dissipation for the lamp tube. To remedy this problem another design has been adopted by fabricating a heat conductive aluminum casing to seal the LED lamp strip inside via resin. However, such a design requires complicated process, and the product also is not repairable. In other occasions, such as illumination in a cryogenic environment like providing lighting for the interior of refrigerators, uniform illumination is required. Although the conventional fluorescent lamp can provide a wide projection angle, illumination attenuates drastically. As a result, luminosity is deficient in the middle portion of the refrigerator or luminosity is greater at two sides. This results in less desirable overall illumination uniformity. How to design the LED lamp with a specific projection angle to achieve greater luminosity and total uniformity is an urgent issue remained to be resolved in the industry. Moreover, the conventional LED lamp tubes generally have power lines threading through from one side. Such a structure makes installation more difficult and also creates a great deal of confusion during installation with prolific types of LED lamps. To reduce the problems of numerous LED lamp types and complex installation, a common model of the LED lamp is adopted to meet a wide variety of requirements.

SUMMARY OF THE INVENTION

The primary object of the present invention is to solve the aforesaid disadvantages in the conventional techniques by providing an LED lamp tube with improved sealing and cooling performance.

Another object of the invention is to provide an LED lamp tube and a lamp tube casing thereof that render uniform illumination and also facilitate installation.

To achieve the foregoing objects, the invention provides a waterproof LED lamp tube that includes a plastic tube shell, an LED lamp strip, a metal casing and two end caps. The plastic tube shell is elongate and includes a light condensing structure and a light reflection structure integrally formed by extrusion and an installation chamber formed between the light condensing structure and the light reflection structure. The LED lamp strip is held in the installation chamber and at one side of the light reflection structure. The metal casing is coupled on an outer side of the light reflection structure. The end cap is coupled on each of two ends of the plastic tube shell. As the light condensing structure and light reflection structure are integrally formed by extrusion and the LED lamp strip is installed between the light condensing structure and light reflection structure, there is no gap or crevice formed between them, and hence a fully sealing effect can be accomplished. With the two ends of the plastic tube shell sealed by the end caps, an IP67 waterproof and dustproof level can be attained. Moreover, as the outer side of the plastic tube shell is coupled by the metal casing in a tight contact manner, heat generated by the LED lamp strip can be quickly dispersed. As a result, the cooling problem of the lamp tube also can be resolved.

The invention further provides an LED lamp tube casing including an elongate plastic tube shell mentioned above. The plastic tube shell includes a light condensing structure and a light reflection structure integrally formed by extrusion, and an installation chamber formed between the light condensing structure and light reflection structure. The light reflection structure is formed in an L shape. The light condensing structure is inclined to connect to an upper edge and a lower edge of the light reflection structure. The light condensing structure adopted in the invention can increase illumination of the LED. The light condensing structure is inclined against the plane where the LED lamp strip is located, so that after light passes through the light condensing structure, it projects to different distances but with substantially the same illumination. Therefore the LED lamp can produce uniform projection luminosity within a selected range.

The LED lamp tube of the invention provides many advantages, such as improved sealing and cooling performance, and can function desirably in a damp environment or outdoor environment, and also has a longer lifespan than the conventional LED lamp tube. Aside from enhancing illumination luminosity, it also provides substantially same projection luminosity at different distances within a selected range. The feature of uniform luminosity makes the invention applicable for internal illumination for a wide variety of facilities with improved illumination effect better than the conventional incandescent lamps and ordinary LED lamp sets. In addition, the end cap of the invention has conductive metal pins located thereon to connect to an external power source, hence both ends are installable. As a result, one product type can support two types of installation, i.e. left side or right side installation. Product installation is easier, and simplified product types can save more than 50% of costs.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
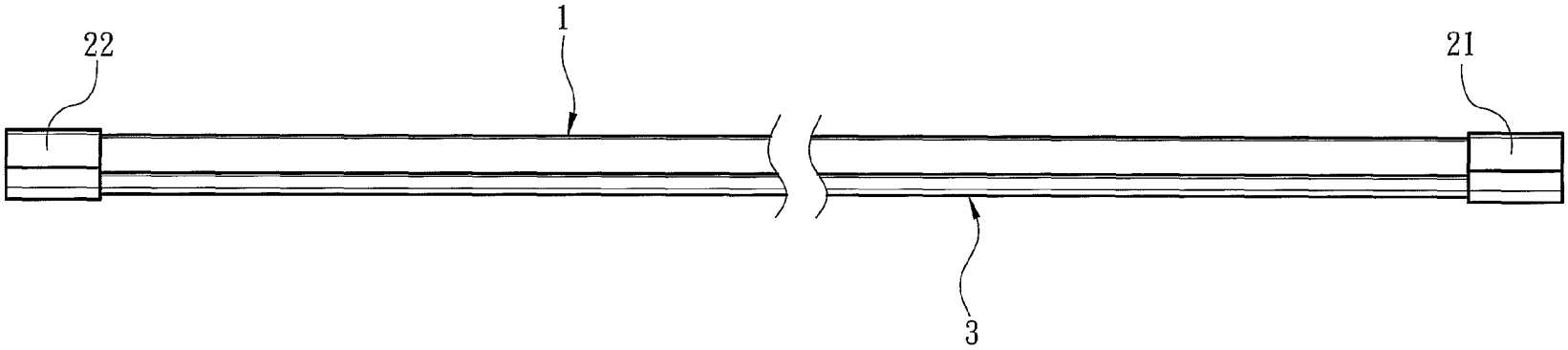
FIG. 1 is a plane view of a first embodiment of the invention.
Figure 2:
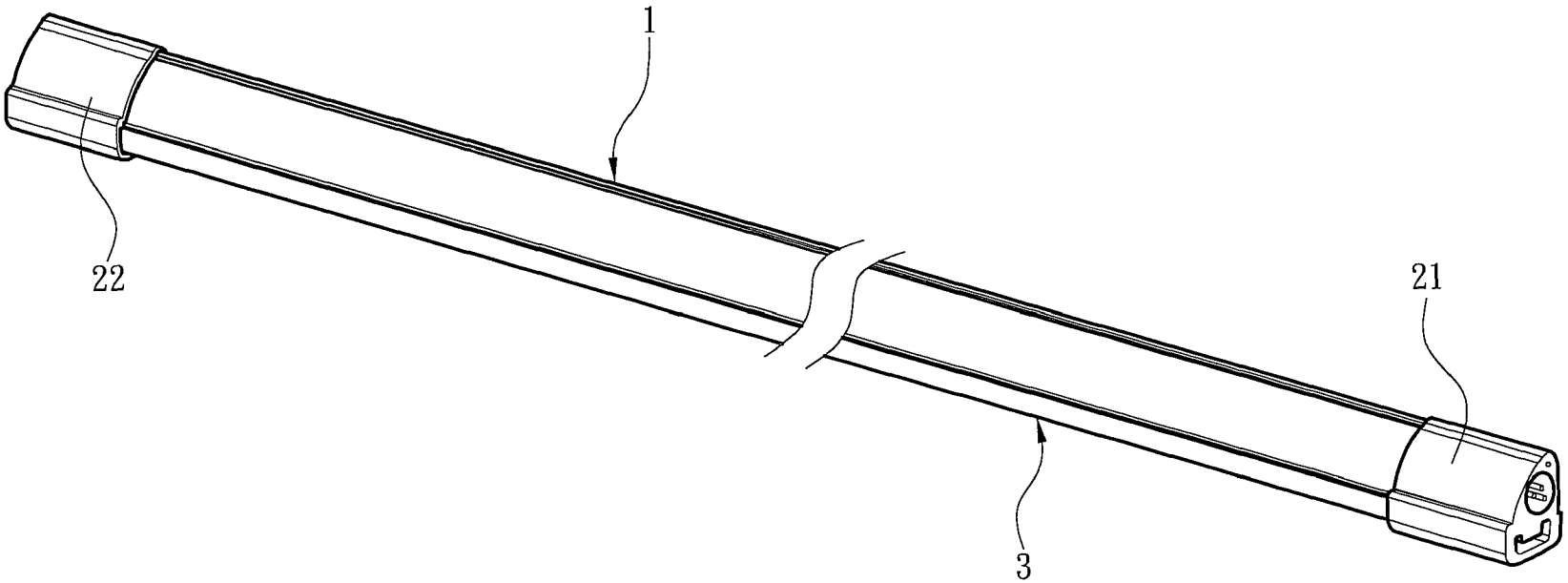
FIG. 2 is a perspective view of the first embodiment of the invention.
Figure 3:
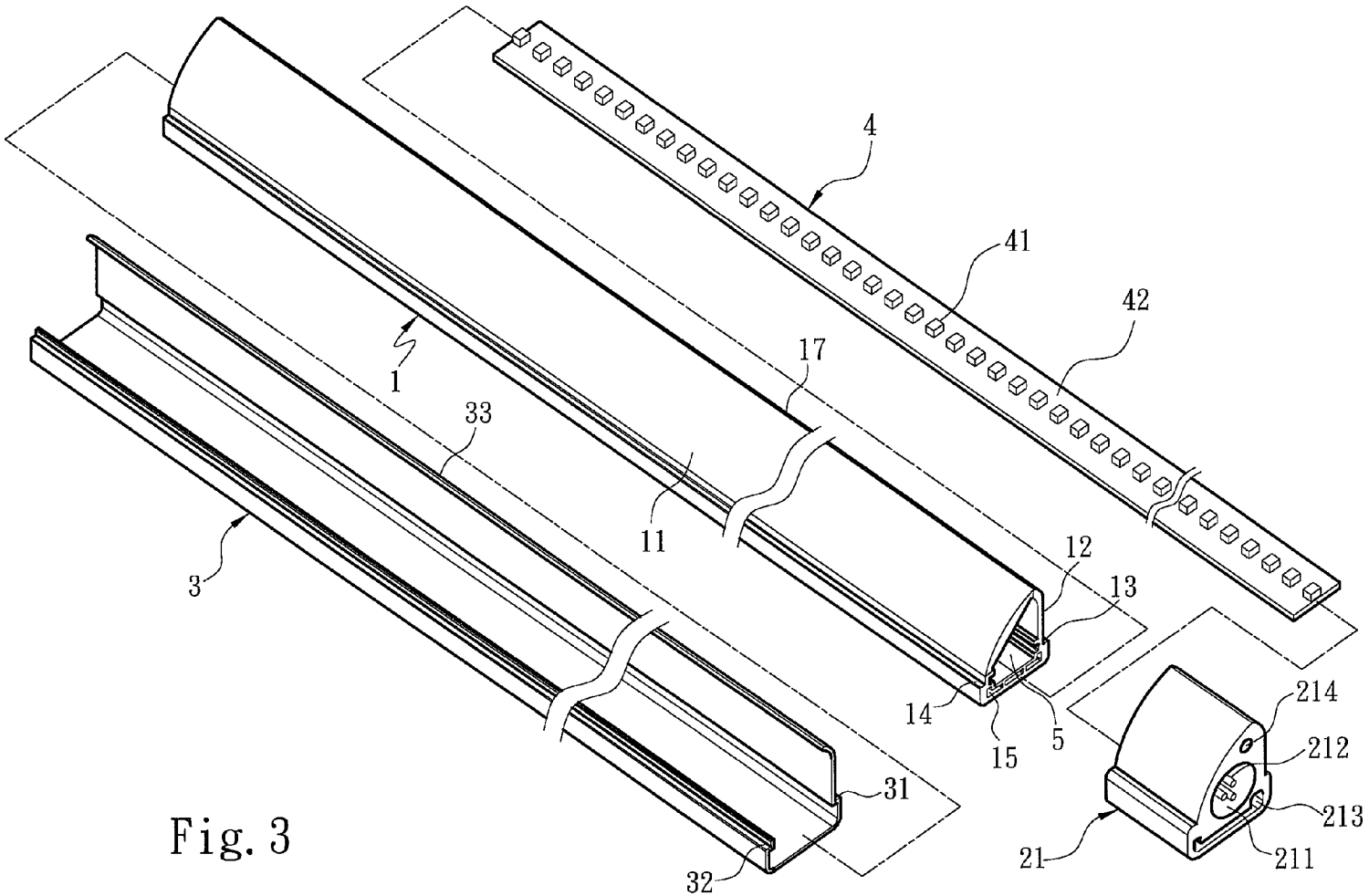
FIG. 3 is an exploded view of the first embodiment of the invention.
Figure 4:
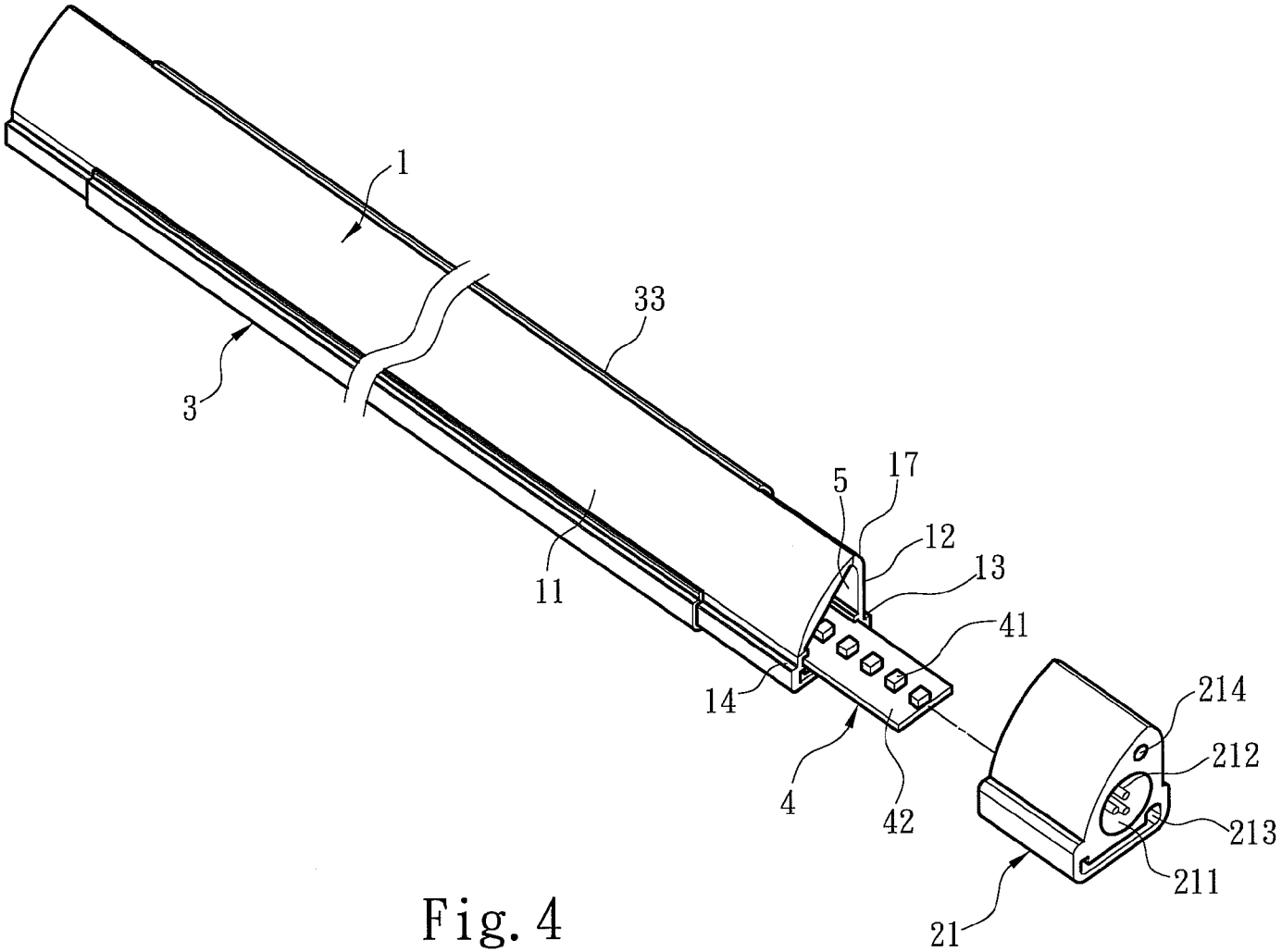
FIG. 4 is a schematic view of the first embodiment of the invention for installation.

Please refer to FIGS. 1 and 2, the present invention aims to provide a waterproof LED lamp tube which includes a plastic tube shell 1 and a metal casing 3. The plastic tube shell 1 is wedged in the metal casing 3 with two ends sealed respectively by an end cap 21 and 22. The metal casing 3 is made of light weight aluminum or other metals such as copper or silver that can rapidly absorb and disperse heat. The plastic tube shell 1 holds an LED lamp strip 4 inside. Also referring to FIG. 3, the LED lamp strip 4 is installed at the bottom of the plastic tube shell 1. The LED lamp strip 4 includes a printed circuit board (PCB in short hereinafter) 42 and a plurality of LEDs 41 installed on the PCB 42. Referring to FIG. 4, the plastic tube shell 1 and LED lamp strip 4 are respectively formed at a length greater than that of the metal casing 3 such that the plastic tube shell 1 has a portion extended outside the metal casing 3 to be coupled with the end cap. After the LED lamp strip 4 has been installed, two ends of the plastic tube shell 1 are sealed with sealant to form sealing desired and then are coupled with the end caps 21 and 22. As shown in the drawings, the end cap 21 has a round socket cavity 211 formed thereon to facilitate plugging of an external power source from any angles. The socket cavity 211 holds three conductive metal pins 212 running through the sealant to form electric connection with the LED lamp strip 4. The end cap 21 also has a positioning hole 214 and a positioning slot 213, while another end cap 22 only has the socket cavity and three conductive metal pins, but does not have the positioning hole and the positioning slot. Thus the LED lamp tube can be connected to the external power source through two ends to facilitate installation. The LED lamp tube can be positioned securely through the positioning hole 214 and positioning slot 213 formed on the end cap 21. In another embodiment, another end cap can also have a positioning hole or a positioning slot formed thereon.

Figure 5:
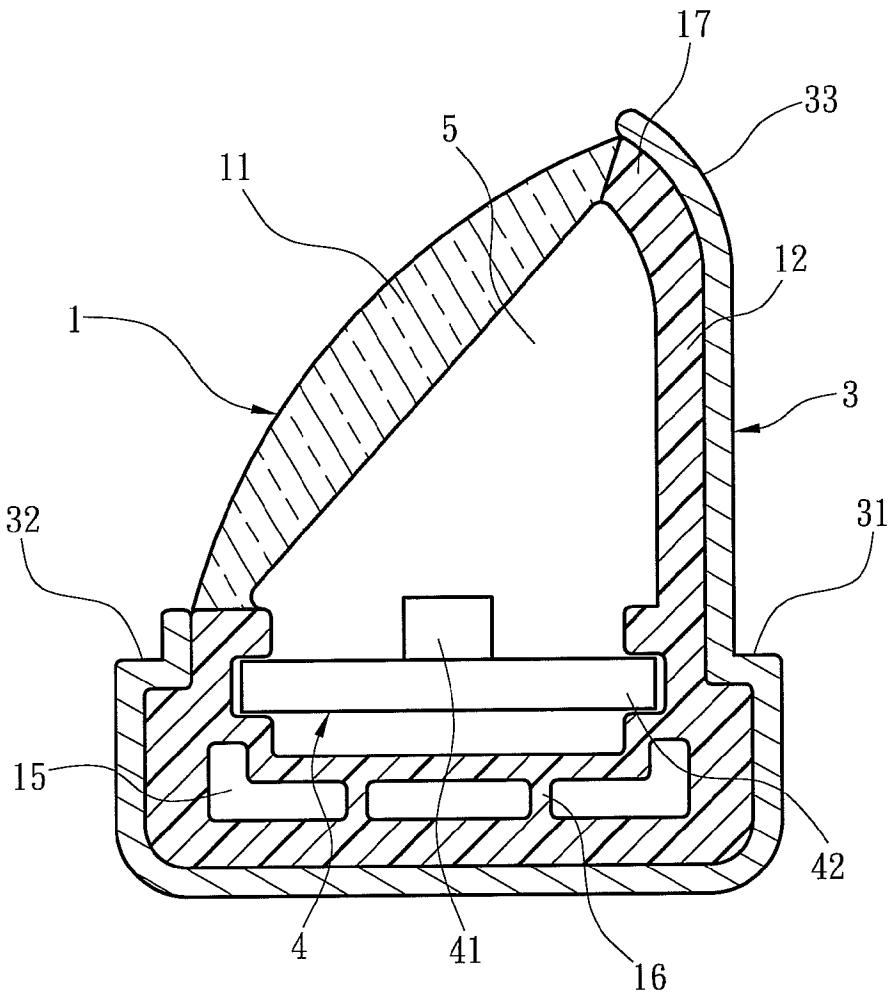
FIG. 5 is a cross section of the first embodiment of the invention.
Figure 7:
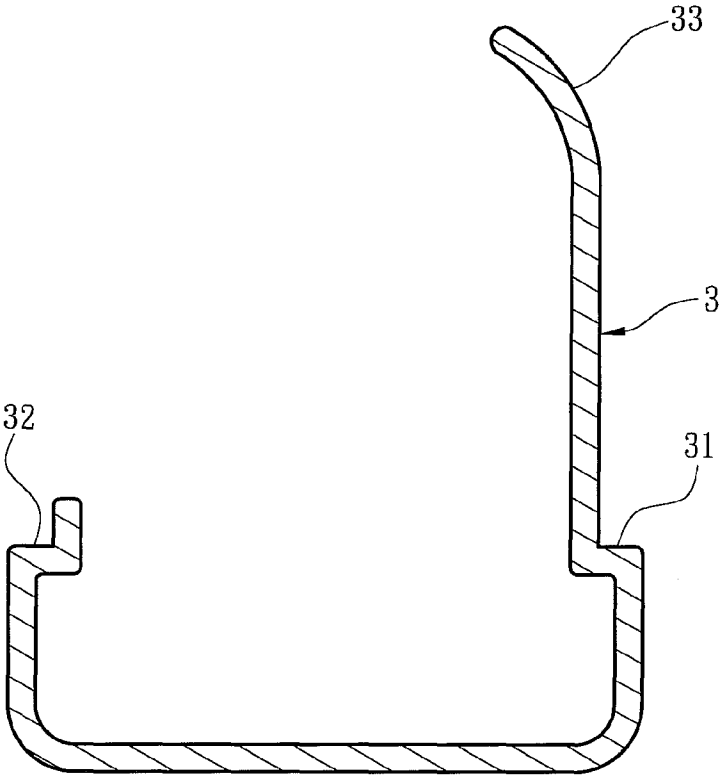
FIG. 7 is a cross section of the metal casing for the first and second embodiments.
Figure 8:
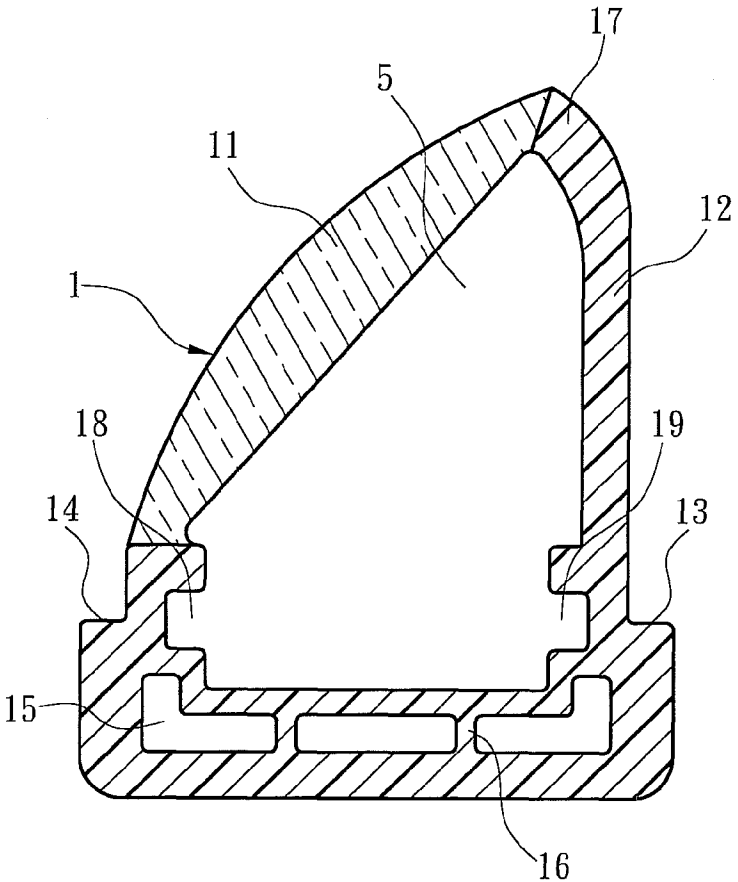
FIG. 8 is a cross section of the plastic tube shell of the first embodiment of the invention.

The socket cavity may be formed in a triangular shape or other shapes. Refer to FIG. 5 for coupling of the plastic tube shell 1, metal casing 3 and LED lamp strip. FIG. 7 also illustrates detailed structure of the metal casing 7, while FIG. 8 shows the detailed structure of the plastic tube shell 1. The metal casing 3 is formed in an L shape with two sides of the bottom thereof extended outwards to form second stepped structures 31 and 32 and with a top end of one side extended upright to form a bend portion 33 bent slightly inwards. The plastic tube shell 1 includes a light condensing structure 11 and a light refection structure 12 formed integrally by extrusion and an installation chamber 5 formed between the light condensing structure 11 and the light refection structure 12. The light condensing structure 11 has an arched outer surface to form a convex structure. The light condensing structure 11 is made of a transparent or translucent material. The light reflection structure 12 is made of a white material and formed in an L shape with two sides of the bottom thereof extended outwards to form first stepped structures 13 and 14 to mate the second stepped structures 31 and 32 of the metal casing 3. The light condensing structure 11 is inclined to connect to an upper edge and a lower edge of the light reflection structure 12. The inclined angle is formed at 45 degrees in this embodiment, but can be ranged from 15 degrees to 75 degrees according to actual requirements, preferably between 45 and 65 degrees. The light reflection structure 12 has an arched section 17 bent inwards at the portion connecting to the light condensing structure 11 to mate the bend portion 33 of the metal casing 3. The light reflection structure 12 has two longitudinal installation grooves 18 and 19 formed on two inner sides of the bottom thereof to receive the PCB 42 of the LED lamp strip 4 as shown in FIG. 4. The bottom of the light reflection structure 12 also has three longitudinal through holes 15 formed inside and separated by longitudinal partitions 16.

As previously discussed, the light condensing structure 11 and light reflection structure 12 are made of materials with different colors and integrally formed by extrusion, hence connecting portions of the light condensing structure 11 and light reflection structure 12 are completely matched without any gaps or crevices formed between them. As two ends of the plastic tube shell 1 are sealed by the sealant, the chamber 5 also is fully sealed. As a result, the LED lamp strip 4 can function properly in a damp environment. Since the light condensing structure 11 adopts the convex structure, illumination of the lamp tube is enhanced. Moreover, as the light condensing structure 11 is inclined at an angle of 45 degrees, light can project evenly within a selected illumination distance. In addition, as the first stepped structures 13 and 14 and arched section 17 of the light reflection structure 12 mate the second stepped structures 31 and 32 and bend portion 33 of the metal casing 3, the metal casing 3 can tightly contact with the plastic tube shell 1 and couple on the outer side of the light reflection structure 12, thus maximum contact area with the plastic tube shell 1 is provided and maximum light projection area is also achieved without covering the light condensing structure 11 of the plastic tube shell 1. As a result, heat generated by the LED lamp strip 4 can pass through the plastic tube shell 1 and be absorbed by the metal casing 3 and rapidly dispersed outwards to quickly lower the temperature of the lamp tube and resolve the cooling problem that might otherwise occur. The through holes 15 formed at the bottom of the light reflection structure 12 can reduce total weight and material cost of the structure. In the event that weight or material cost is not a big concern, the bottom of the light reflection structure 12 may be formed in a solid structure without the through holes, as depicted in embodiments shown in FIGS. 6 and 9. Aside from omitting the through holes, all other structures are same as the embodiment previously discussed.

Figure 6:
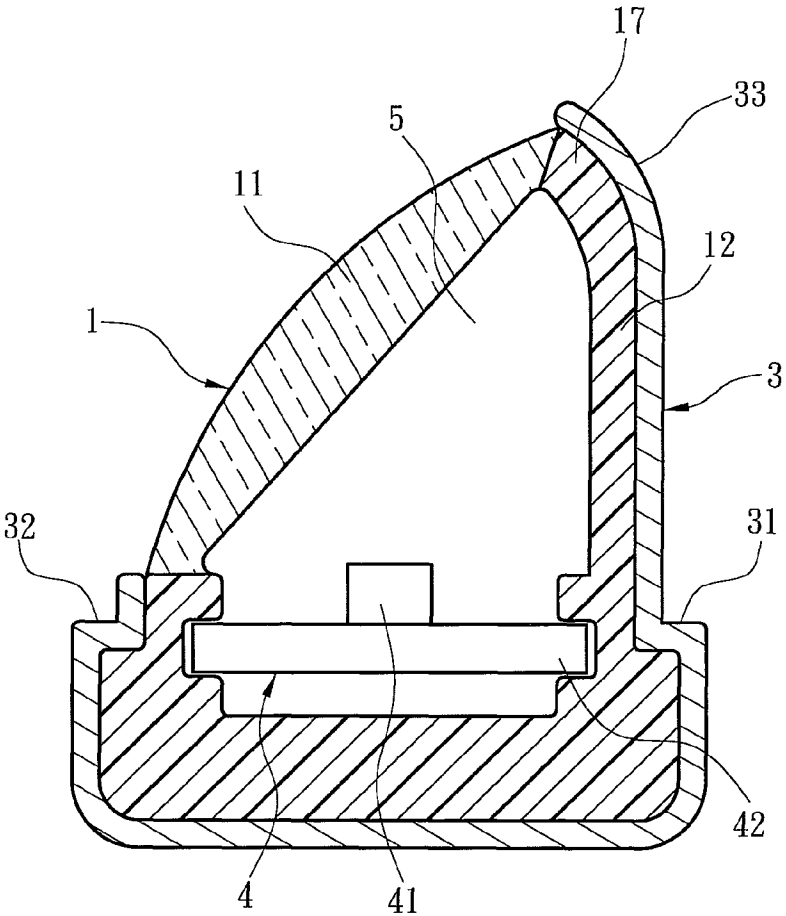
FIG. 6 is a cross section of a second embodiment of the invention.
Figure 9:
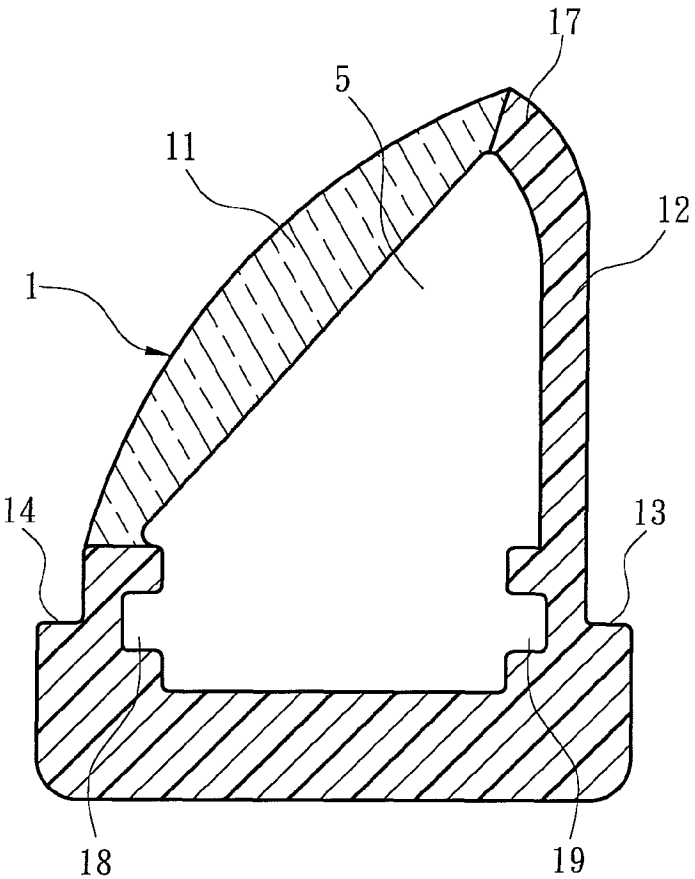
FIG. 9 is a cross section of the plastic tube shell of the second embodiment of the invention.

The invention also aims to protect the LED lamp tube casing as the embodiments shown in FIGS. 6 and 9. When used in certain low temperature environments, such as a refrigerator, desired cooling can be maintained even without the metal casing to keep the LED lamp strip in a desirable working condition and provide the advantages of greater luminosity and uniform illumination.

What is claimed is:

1. A waterproof LED lamp tube, comprising:

a plastic tube shell which is elongate and includes a light condensing structure and a light reflection structure integrally formed by extrusion and an installation chamber formed between the light condensing structure and the light reflection structure;

an LED lamp strip held in the installation chamber and at one side of the light reflection structure;

a metal casing to couple the light reflection structure on an outer side thereof; and an end cap to couple with each of two ends of the plastic tube shell.

2. The waterproof LED lamp tube of claim 1, wherein the light condensing structure includes an arched outer surface to form a convex structure and is made of a transparent material or a translucent material, the light reflection structure being made of a white material.

3. The waterproof LED lamp tube of claim 2, wherein the light reflection structure is formed in an L shape, the light condensing structure being inclined to connect to an upper edge and a lower edge of the light reflection structure, the LED lamp strip being installed on the bottom of an inner side of the light reflection structure, the metal casing being formed in an L shape to couple with the outer side of the light reflection structure.

4. The waterproof LED lamp tube of claim 3, wherein the light condensing structure is inclined at an angle ranged from 15 degrees to 75 degrees.

5. The waterproof LED lamp tube of claim 4, wherein the light condensing structure is inclined at an angle ranged from 45 degrees to 65 degrees.

6. The waterproof LED lamp tube of claim 3, wherein the light reflection structure includes a first stepped structure extended outwards from two sides of the bottom thereof, the metal casing including a second stepped structure extended outwards from two sides of the bottom thereof to latch on the first stepped structure of the light reflection structure.

7. The waterproof LED lamp tube of claim 6, wherein the light reflection structure includes a longitudinal installation groove on each of two inner sides of the bottom thereof to receive the LED lamp strip, the two ends of the plastic tube shell being sealed via sealant.

8. The waterproof LED lamp tube of claim 7, wherein the light reflection structure includes at least one longitudinal through hole inside the bottom thereof.

9. The waterproof LED lamp tube of claim 8, wherein the longitudinal through hole inside the bottom includes multiple sets ranged from two to five and separated by longitudinal partitions.

10. The waterproof LED lamp tube of claim 5, wherein the light reflection structure includes a first stepped structure extended outwards from two sides of the bottom thereof, the metal casing including a second stepped structure extended outwards from two sides of the bottom thereof to latch on the first stepped structure of the light reflection structure.

11. The waterproof LED lamp tube of claim 10, wherein the light reflection structure includes a longitudinal installation groove on each of two inner sides of the bottom thereof to receive the LED lamp strip, the two ends of the plastic tube shell being sealed via sealant.

12. The waterproof LED lamp tube of claim 11, wherein the light reflection structure includes at least one longitudinal through hole inside the bottom thereof.

13. The waterproof LED lamp tube of claim 12, wherein the longitudinal through hole inside the bottom includes multiple sets ranged from two to five and separated by longitudinal partitions.

14. The waterproof LED lamp tube of claim 1, wherein the end cap includes conductive metal pins to form electric connection with the LED lamp strip.

15. The waterproof LED lamp tube of claim 14, wherein the end cap includes a positioning hole or a positioning slot or a positioning hole together with a positioning slot.

16. The waterproof LED lamp tube of claim 13, wherein the end cap includes conductive metal pins to form electric connection with the LED lamp strip.

17. The waterproof LED lamp tube of claim 16, wherein the end cap includes a positioning hole or a positioning slot or a positioning hole together with a positioning slot.

18. An LED lamp tube casing comprising an elongate plastic tube shell which includes a light condensing structure and a light reflection structure integrally formed by extrusion and an installation chamber formed between the light condensing structure and the light reflection structure; the light reflection structure being formed in an L shape, the light condensing structure being inclined to connect to an upper edge and a lower edge of the light reflection structure.

19. The LED lamp tube casing of claim 18, wherein the light condensing structure includes an arched outer surface to form a convex structure and is made of a transparent material or a translucent material, the light reflection structure being made of a white material.

20. The LED lamp tube casing of claim 19, wherein the light condensing structure is inclined at an angle ranged from 45 degrees to 65 degrees.

* * * * *